US005919392A

United States Patent [19]

Myers et al.

[11] Patent Number: 5,919,392

[45] Date of Patent: Jul. 6, 1999

[54] POURING TUBE STRUCTURE AND ASSEMBLY

[75] Inventors: Jonathan L. Myers, Hoover, Ala.; Gary M. Peevler, Keokuk, Iowa

[73] Assignee: Griffin Wheel Company, Chicago, Ill.

[21] Appl. No.: 08/992,275

[22] Filed: Dec. 17, 1997

[51] Int. Cl.[6] ..... B22D 35/00

[52] U.S. Cl. ..... 222/606; 164/337

[58] Field of Search ..... 222/591, 594, 222/606, 607; 164/337; 266/236

[56] References Cited

U.S. PATENT DOCUMENTS

| | | | |
|---|---|---|---|
| 3,054,155 | 9/1962 | Zickefoose | 164/337 |
| 3,279,003 | 10/1966 | Yates | 222/606 |
| 3,322,186 | 5/1967 | Tackacs Jr., et al. | 164/337 |
| 3,508,615 | 4/1970 | Troy | 164/337 |
| 5,310,098 | 5/1994 | Edwards | 222/591 |

*Primary Examiner*—Scott Kastler
*Attorney, Agent, or Firm*—Edward J. Brosius; F.S. Gregorczyk; Stephen J. Manich

[57] ABSTRACT

In a bottom-pouring casting apparatus having a holding tank, a ladle in the tank and a tank cover, which seals the ladle in the tank, a pouring tube and holding casting are disclosed for mounting on and through the tank cover to provide the pouring tube in the molten metal of the ladle, which tube and holding casting are have similarly tapered outer and inner walls for mating at assembly thereby utilizing gravity and mechanical pressure on the tube holding assembly to more tightly secure the tube agains the holding casting to avoid driving the tube from the holding casting and rendering it inoperable.

8 Claims, 5 Drawing Sheets

POURING TUBE STRUCTURE AND ASSEMBLY

BACKGROUND OF THE INVENTION

1. Field of the Invention

The present application relates to pouring appartatus for casting molten metals into molds. More specifically, the invention relates to a pouring tube and tube holding apparatus for bottom-pressure pouring molten metals from a holding ladle or tank.

2. Prior Art

Historically molten metals were initially cast by a gravity flow into either ingot form or shaped molds. Methods were later developed to cast molten metals from the bottom of the mold. The bottom pouring technique for casting molten metal into ingot molds utilized an elongate tubular structure lined with refractory brick, which tube structure was higher than the height of the ingot to be cast. A channel in the ingot mold stool extended from the bottom of the elongate tube to the base of the open ingot mold with open outlets exposed to the mold interior. Thereafter, molten metal poured through the tubular structure flowed to the ingot mold. This casting technique produced ingots with less pipe and, therefore, greater recovery of the as-cast steel.

Molten metal from a melting furnace is generally tapped into a ladle, which has a nozzle in its base with a stopper and stopper rod assembly securing and controlling fluid flow from the ladle. Control of the pouring rate of a bottom-poured ingot casting is, or can be, accomplished by controlling the flow of metal from the ladle to the elongate tubular structure. Discussion of these pouring practices and some illustrative ingot mold and ladle nozzle assemblies are shown in Basic Open Hearth Steelmaking, from the American Institute of Mining, Metallurgical, and Petroleum Engineers, New York, 1964. Other illustrative casting mold structures for bottom pouring are schematically illustrated in the Making, Shaping and Treating of Steel, United States Steel Corporation, 1964.

Similarly, ladles are used to transfer molten metal for casting into sand molds, die casting or other casting operations. These casting techniques utilize the gravity feed method or an operation similar to the bottom-poured ingot casting. However, there are inherent problems with heat loss and rate of pouring which impact the integrity of the cast product both internally and externally. As a consequence, a bottom-pouring casting technique utilizing the pressurization of a ladle to forcibly move molten metal, particularly steel, was developed. In this method, metal is transferred into a mold without transferring it through a long, tortuous, brick-lined channel, which was expensive to construct and maintain as well as resulting in significant heat losses. This bottom-pressure casting technique was developed in the middle of the twentieth century and has found particular application in the production of railroad wheels, as it produces wheels with consistent internal integrity and with a minimal number of external flaws.

One of the problems associated with this bottom-pressure casting is communication of the molten metal to the mold. This requires elevation of the gas pressure above the molten metal bath in the sealed ladle or holding tank to mechanically force the molten metal up a pouring tube. Further, the seal between the mold and the pouring tube must be maintained to sustain a steady gas pressure for smooth transfer of molten metal to the mold. Consequently, mold equipment and casting practices are constantly under review and development, as their improvement leads to higher quality products and generally lower costs of production, through the lowering of labor or tool costs, for example.

Illustrative of the concern for maintaining the structure of the pouring tube is the teaching of U.S. Pat. No. 3,054,155 to Zickefoose. In this patent, the general structure and physical characteristics of the pouring tubes are described and the exposure of the tubes to the hostile environment of molten metal is noted. The reduction in thermal shock to the tube from a large change in temperature was accommodated by preheating the tube in accord with the thermal expansion characteristics of the specific tube material. The illustrated tilt to the pouring tube structure was to prevent the entrapment of air within the casting cavity. As noted in FIG. 2 of the Zickefoose—'155 patent, pouring tube 21 is a cylindrical tube with a straight outer sidewall, which tube is secured in housing 12 by a cement like mixture 22. There is no mechanical consideration for the tube and/or tube assembly to bear the vertical load from the mold.

U.S. Pat. No. 3,279,003 to Yates discloses a means to maintain a vertically arranged, refractory, cylindrical tube in position for casting molten metals. A steel shell around the refractory tube provides strength and forms an impermeable membrane. A cement is placed between the refractory tube and the steel shell to secure the tube in position.

U.S. Pat. No. 3,322,186 to Takacs, Jr. et al. taught a means to accommodate the vertical motions acting on the pouring tube or more broadly on the casting and mold apparatus arrangement. In an effort to mate the two components, mold and pouring apparatus, power driven cylinder rams were taught for raising and lowering the pouring tube. Pouring tube 22 is a straight tubular shape with a head element 58 secured on its upper end, and head element 58 fits into a recess in the gate assembly 40 of the car and mold unit. In FIG. 2 of this Takacs, Jr. et al.—'186 patent, tube 52 is mated in casing 56 and refractory sand 54 is interposed between casing 56 and tube 52. Another arrangement for holding the pouring tube is illustrated in FIG. 3, wherein a refractory cement 106 is noted between tube 102 and metal sheath 108. However, there is no mechanical, vertical support for tubes 22 or 102 in any of these disclosures.

Another pouring tube structure is noted in U.S. Pat. No. 3,508,615 to Troy, wherein vertical tube 32 is secured in position by refractory grout 58 between ferrule 30 and the tube outer wall. In addition, an impermeable sleeve 60 is mounted at the lower end of tube 32 and maintained in position by refractory wrap 64. None of the above-cited disclosures accommodates the vertical loads placed upon the tube by the mold or mold assembly.

The present invention provides an assembly to more securely retain the pouring tube in position while reducing its exposure to mechanical damage from the mold. The resulting better seat for the mold also provides a more consistent positioning of the mold or mold nozzle and a better retention of the gas pressure head in the molten metal ladle or holding tank.

SUMMARY OF THE INVENTION

The present invention provides a pouring tube assembly for a bottom-pouring casting apparautus or pouring tank arrangement. The pouring tube assembly includes a mechanical constraint for the pouring tube, holding casting and parting ring, which results in a secure union of the components. The pouring-tube assembly is integratable into present equipment without excess development and redesign. The integrity of the gas-tight, holding-tank seal is enhanced, and the pouring tube upper end is more protected from mechanical damage than in present structures. Protection of the structural integrity of the pouring tube head or upper end, which is in proximity to the mold nozzle or nozzle well, is an important consideration in casting practice, as it is imperative to avoid metal leakage from the tube end and the entrainment of tramp gasses from the atmosphere. These pouring tubes are by necessity a refractory or ceramic material, as the pouring tube is exposed to elevated temperatures and erosion from flowing molten metal. However, these ceramic materials are generally brittle and susceptible to fracture. Consequently, it is necessary to provide as secure an environment as possible for the protection of these tubes and their exposed tube ends.

BRIEF DESCRIPTION OF THE DRAWING

In the several figures of the Drawing, like reference numerals identify like components, and in those drawings.

DETAILED DESCRIPTION OF THE PREFERRED EMBODIMENT

Figure 1:
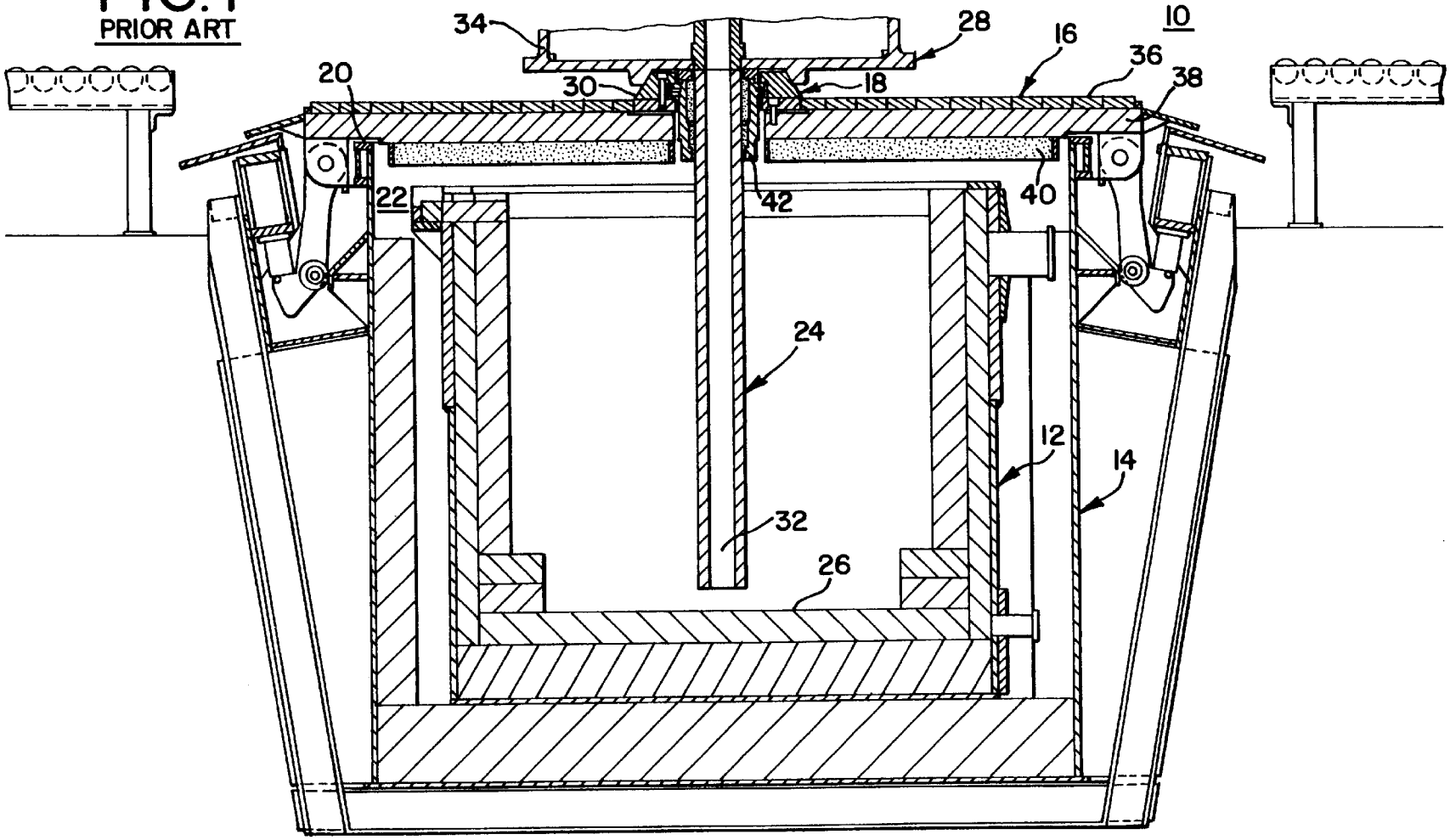
FIG. 1 PRIOR ART
FIG. 1 is a cross-sectional view of an extant pouring tube assembly and holding tank for a bottom-pouring casting apparatus.

An exemplary prior art bottom pouring tube assembly and holding tank arrangement 10 are noted in FIG. 1. In this figure, ladle 12 is nested in holding tank 14. Tank cover 16 and pouring tube assembly 18 are positioned on tank top 20 to seal chamber 22 and, thus, the molten metal in ladle 12. Pouring tube 24 extends from tank cover 16 into ladle 12 in proximity to ladle bottom 26. This extant arrangement 10 is illustrative of a practice and apparatus utilized for bottom pressure pouring of molten metals and is used for casting railroad wheels.

In a pouring practice utilizing arrangement 10 in FIG. 1, mold 28 is mounted on holding ring 30 on tank cover 16. A gas, such as air or an inert gas, is pumped into chamber 22 through an orifice or valve (not shown) to elevate the pressure above the molten liquid in ladle 12. The elevated pressure above the molten metal bath increases the pressure until the molten metal is forced up passage 32 of tube 24 into a cavity (not shown) of mold 28.

The structure of arrangement 10 is both large and heavy. Indicative of the mass of the several components it is noted that a railroad wheel weighs 500 pounds or more. Therefore, the components for casting such parts are significant in size. As an example, mold 28 has plate-steel frame 34 for containing a blank pattern in sand or graphite to retain the molten 500 pounds of steel. Mold 28 and the cast wheel therein are nested on pouring tube assembly 18 atop cover 16, which cover 16 has plate metal top 36 with refractory material layer 38 and heat cover 40. Ladle 12 in tank 14 generally contains enough molten metal to cast several wheels, which implies about 3 or 4 tons of molten metal. In addition, ladle 12 has a plate metal shell and multiple layers of refractory brick lining, which add significant weight to the already noted heavy components. It can thus be appreciated that the relatively large size of the parts to be cast requires casting equipment components of significant mass. As a specific example, it is known that pouring-tube holding-casting 42 of pouring tube assembly 18 may weigh about 200 pounds, but it appears as a relatively small component in FIG. 1. In consideration of these large components, it is readily apparent that mechanical strength of the casting equipment components is a requisite, and that protection of the smaller, or more fragile, components in a casting practice is necessary if they are to survive the harsh environment of molten metal at elevated temperatures and the interaction with massive weight equipment elements.

Figure 2:
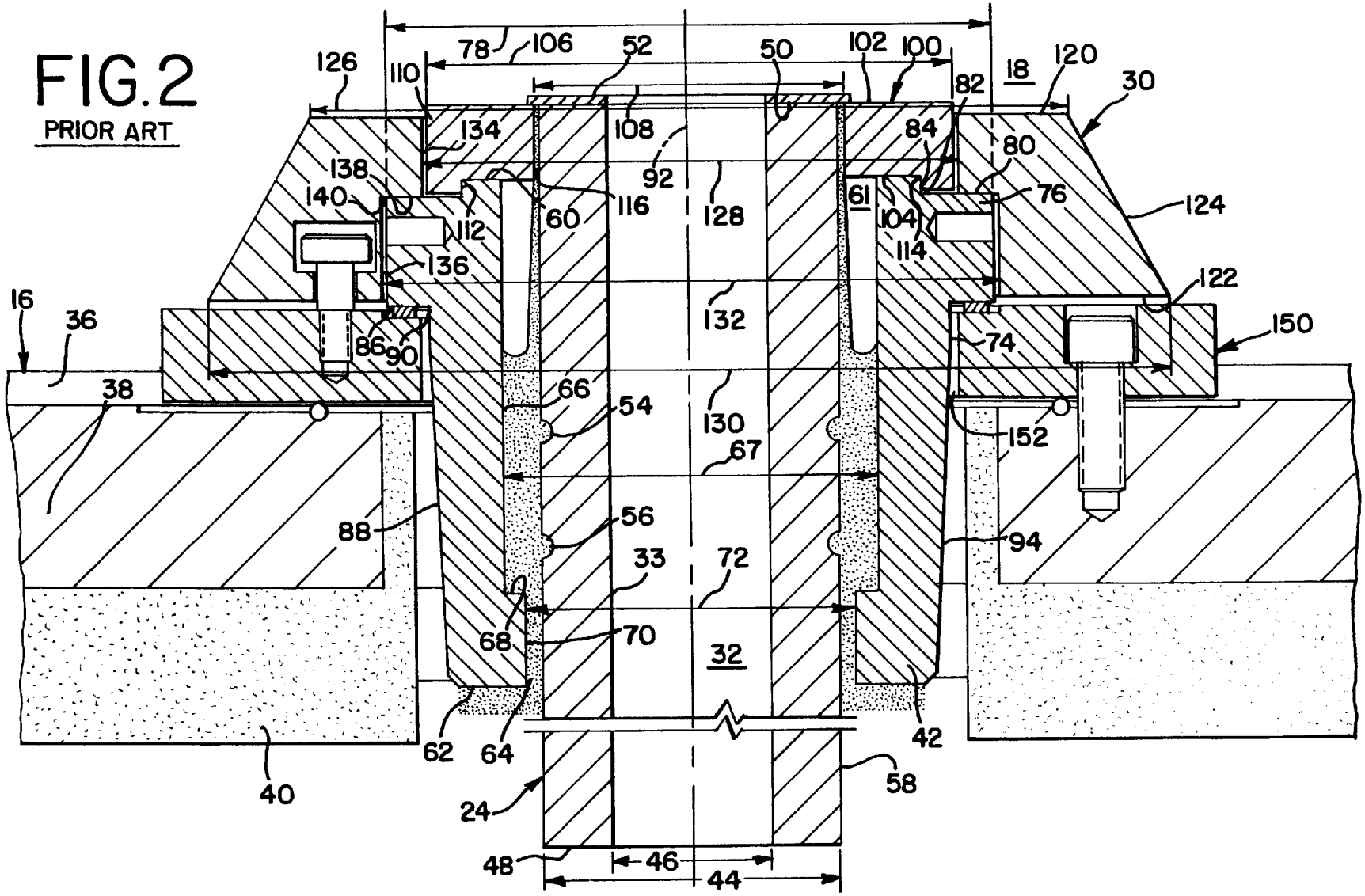
FIG.2 PRIOR ART
FIG. 2 is an enlarged cross-sectional elevational view of an extant pouring tube and tank cover assembly.

FIG. 2 shows a pouring tube assembly 18 similar to the pouring tube assembly of arrangement 10 in FIG. 1. In this enlarged view of FIG. 2, assembly 18 has pouring tube 24 with outer diameter 44 and inner or passage diameter 46. Passage 32 with inner wall 33 is noted as a cylinder extending from tube lower end 48 to upper end 50. Tube gasket 52 is seated on upper end 50 and provides a better seat and seal for mold 28. Tube 32 in this illustration includes first circumferential slot 54 and second circumferential slot 56 on its outer wall 58. Holding casting 42 is generally cylindrical with top 60, bottom 62 and duct 64 extending through casting 42. First inner wall 66 of casting 42 has first inner diameter 67 extending from top 60 to internal wall protrusion 68. Second inner wall 70 has second inner diameter 72 extending from bottom 62 to wall protrusion 68, which second inner wall diameter 70 is less than first inner wall diameter 67. In FIG. 2, holding casting outer wall 74 has collar 76 with outer diameter 78, which collar 76 has upper surface 80 in proximity to, but downwardly displaced from, top 60 to form first shoulder 82 with sidewall 84. Lower surface 86 of collar 76 intersects with outer wall 88 of holding-casting 42 at second shoulder 90. Outer wall 88 inwardly tapers from second shoulder 90 toward longitudinal axis 92 of tube 24 and holding casting 42 to intersect bottom 62. There is an inflection point or ridge 94 in the slope of outer wall 88 where the angle of the taper increases toward longitudinal axis 92.

Parting ring 100 is about an annulus with top side 102, bottom side 104, outer diameter 106 and inner diameter 108. Parting-ring outer wall 110 at outer diameter 106 vertically extends downward beyond the horizontal plane of bottom side 104 and includes inner wall 112. Shoulder 114 occurs at the intersection of parting-ring bottom side 104 with inner wall 112, which has inner diameter 118. Parting-ring bore 116 has inner diameter 108, which is larger than outer-wall diameter 44 of tube 24.

Holding ring 30 in FIG. 2 has a cross-section which appears as an annulus with sloped outer walls 124. In FIG. 2, holding ring 30 has central through-bore 31, upper face 120 with first outer diameter 126 and first inner diameter 128. Lower face 122 has second outer diameter 130 and second inner diameter 132, which second outer diameter 130 is larger than upper-face first outer diameter 126, and second inner diameter 132 is greater than first inner diameter 128. Outer wall 124 is tapered from first outer diameter 126 to second outer diameter 130 to provide ring 30 as a generally frustum-shaped annulus in FIGS. 1 and 3. Holding-ring first inner wall 134 with first inner diameter 128 downwardly extends from upper face 120 to meet horizontal internal wall 138. Second inner wall 136, which is displaced radially outward from axis 92 and first inner wall 134, upwardly extends from lower face 122 to intersect horizontal internal wall 138 at shoulder 140. Lower face 126 of ring 30 contacts support ring 150, which also appears as an annular member and is positioned on tank cover 16 with holding casting 42 extending through support-ring central bore 152.

Cementitious refractory material is applied in passage 64 between tube 24 and holding casting 42. A space or gap 61 is not filled at the upper end of passage 64, as part of the assembly practice of tube assembly 18 in FIG. 2.

Figure 3:
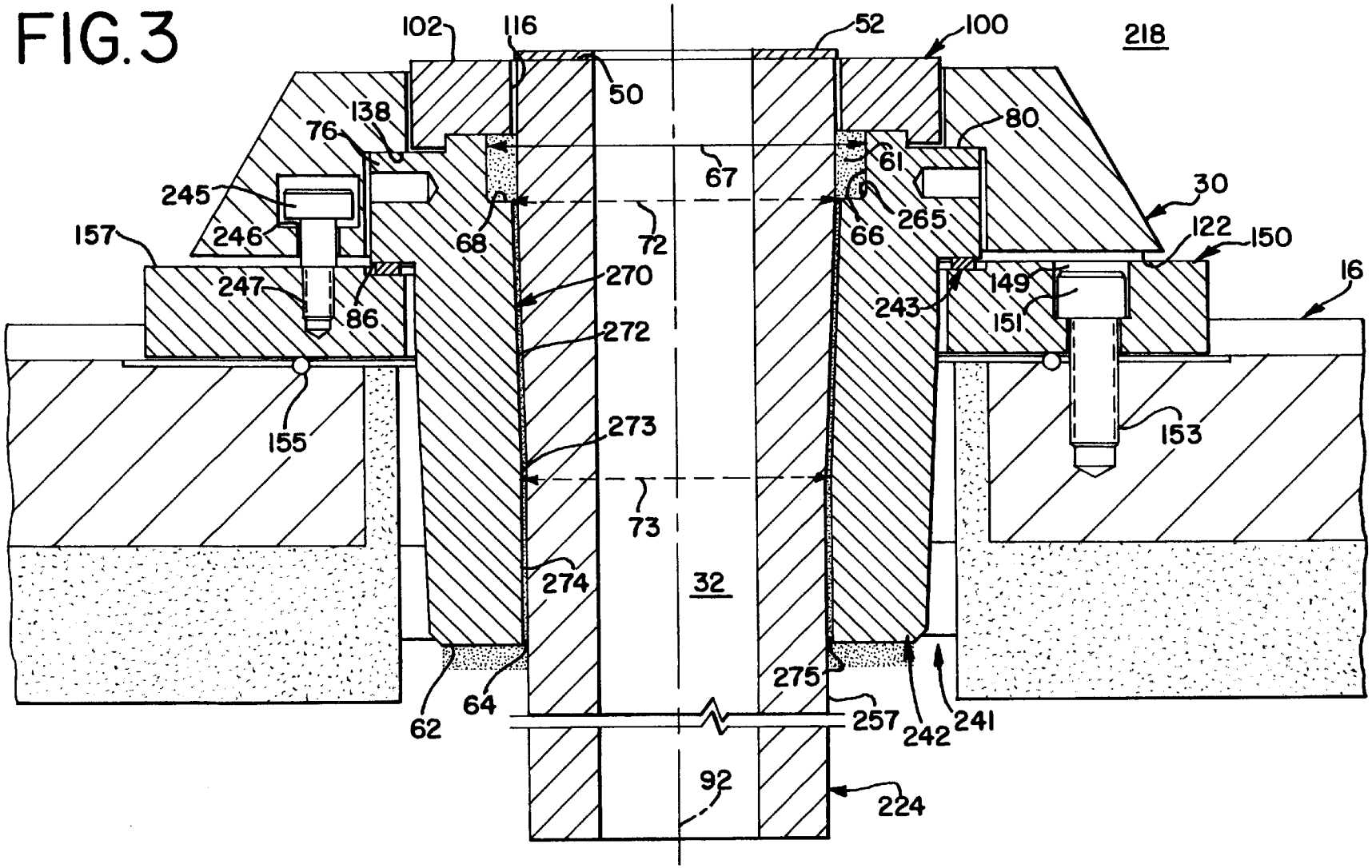
FIG. 3 is a cross-sectional elevational view of the pouring tube and tank cover assembly.

In FIG. 3, the preferred embodiment of the present invention is noted as pouring-tube assembly 218 with holding casting 242, pouring tube 224, parting ring 100, holding ring 30, tube support ring 150 and gasket 52. Holding casting 242 and pouring tube 224 are matable in the same general manner as the above-noted holding casting 42 and tube 24. However, in FIGS. 3 and 5 of this preferred embodiment, holding casting 242 has internal wall protrusion 68 in closer proximity to top 60 than does casting 42. Intersection or shoulder 265 of sidewall or first inner wall 66 in casting 242 appears as a radius and not as a square corner. This is merely as an illustration and not a limitation.

Figures 4, 5, 6:
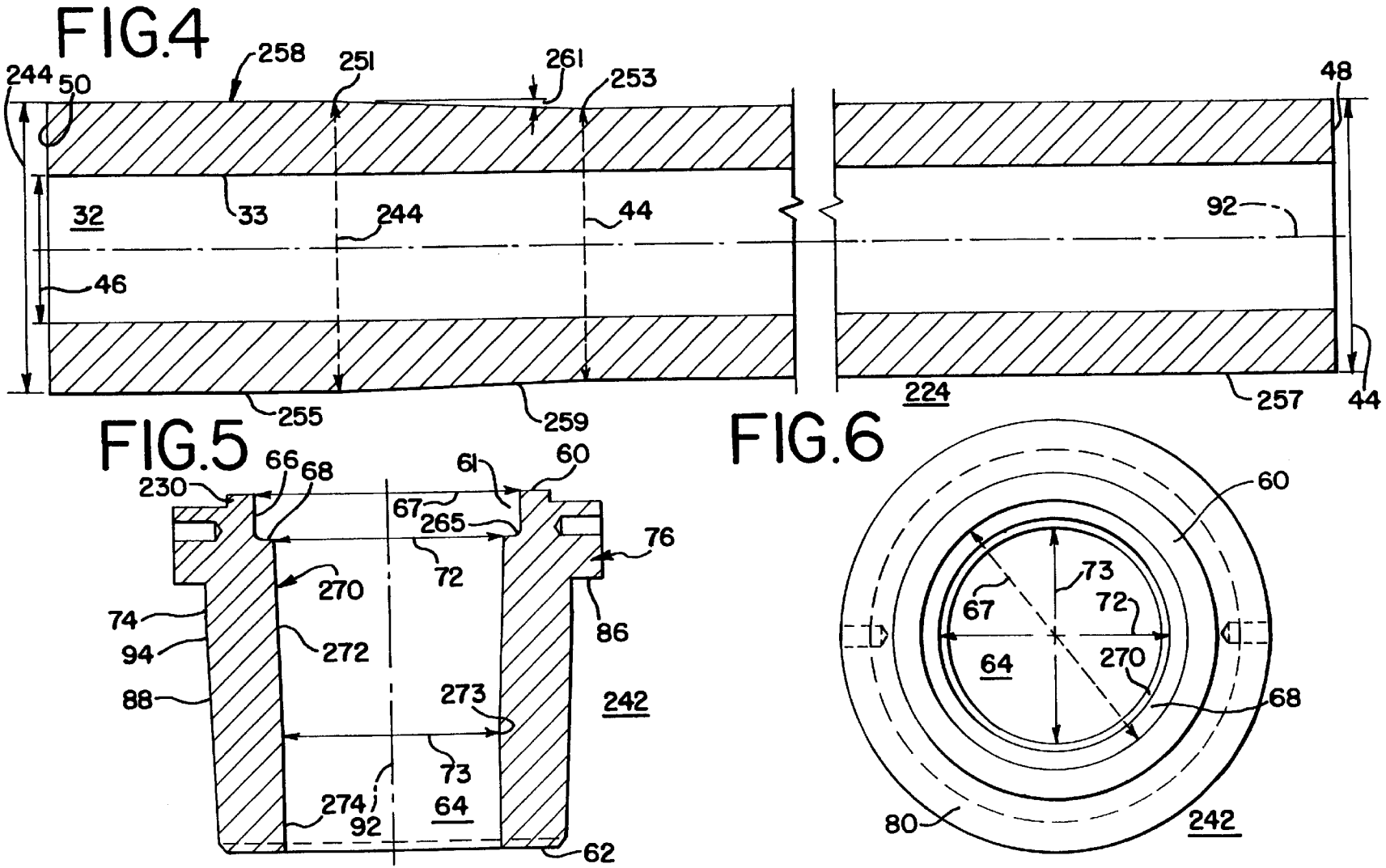
FIG. 4 is a cross-sectional view of the pouring tube in FIG. 3.
FIG. 5 is a cross-sectional view of the holding casting in FIG. 3.
FIG. 6 is a plan view of the holding casting in FIG. 5.

Holding-casting 242 has lower inner wall section 270 extending from internal wall protrusion 68 to bottom 62. Tapered and upper inner wall segment 272 of wall section 270 extends from second diameter 72 to third inner diameter 73, which is smaller than second inner diameter 72. Upper and tapered inner wall segment 272 extends from second inner diameter 72 at wall protrusion 68 downward to third inner diameter 73. Lower and generally cylindrical segment 274 generally vertically extends from third inner diameter 73 to casting bottom 62 and intersects tapered segment 272 at inflection point 273. In FIG. 5, holding-casting, upper, outer-wall section 74 extends generally vertically downward from collar lower face 86. At outer-wall inflection point 94, lower outer wall section 88 angularly tapers inward toward axis 92 to intersect casting bottom 62. Holding casting 242 is shown in plan view in FIG. 6, which illustrates aperture 64, first inner diameter 67, second inner diameter 72 and third inner diameter 73, as well as providing an illustration of the narrow inward taper of vertical wall 270.

Pouring tube 224 in FIGS. 3 and 4 has longitudinal axis 92 and outer wall 258. Passage 32 is generally cylindrical and has inner wall 33 extending between tube lower end 48 and upper end 50, which tube lower end has outer diameter 44. Tube outer wall 258 has upper segment 255 with second tube outer diameter 244 extending from upper end 50 to first inflection point 251 in FIG. 4, which second outer diameter 244 at tube top 50 is greater than outer diameter 44 at tube bottom 48. Tube, outer-wall, lower segment 257 with outer diameter 44 extends generally vertically from tube lower end 48 to second inflection point 253 along wall 258. Third and tapered outer-wall segment 259 is inwardly tapered from first inflection point 251 to second inflection point 253 and diameter 44. Third wall segment 259 is noted in FIG. 4 with inwardly tapering angle 261, which angle may be 2° from vertical, for example.

Figure 7:
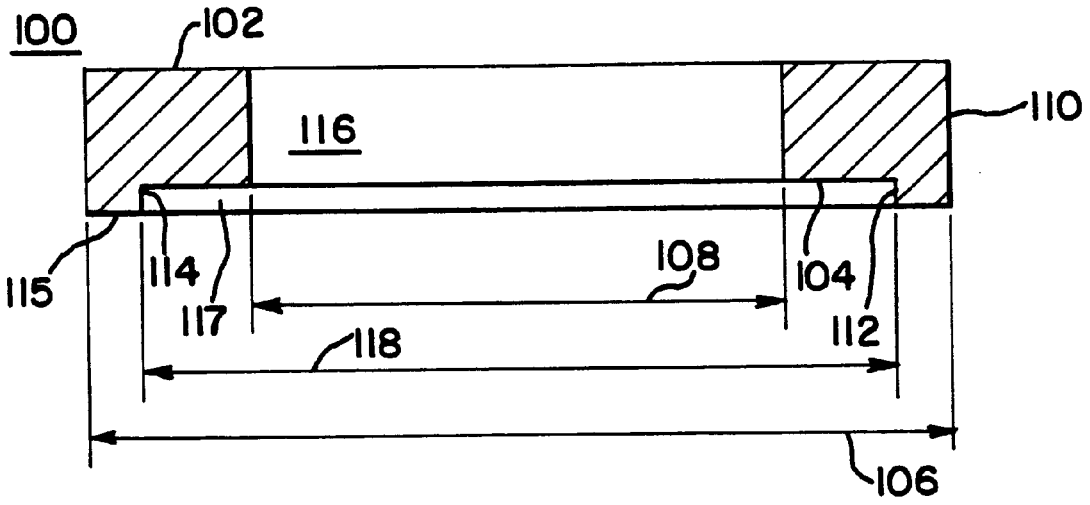
FIG. 7 is a cross-sectional elevation of the parting ring of the assembly of FIG. 3; and, FIG. 8 is a plan view of the parting ring of FIG. 7.
Figure 8:
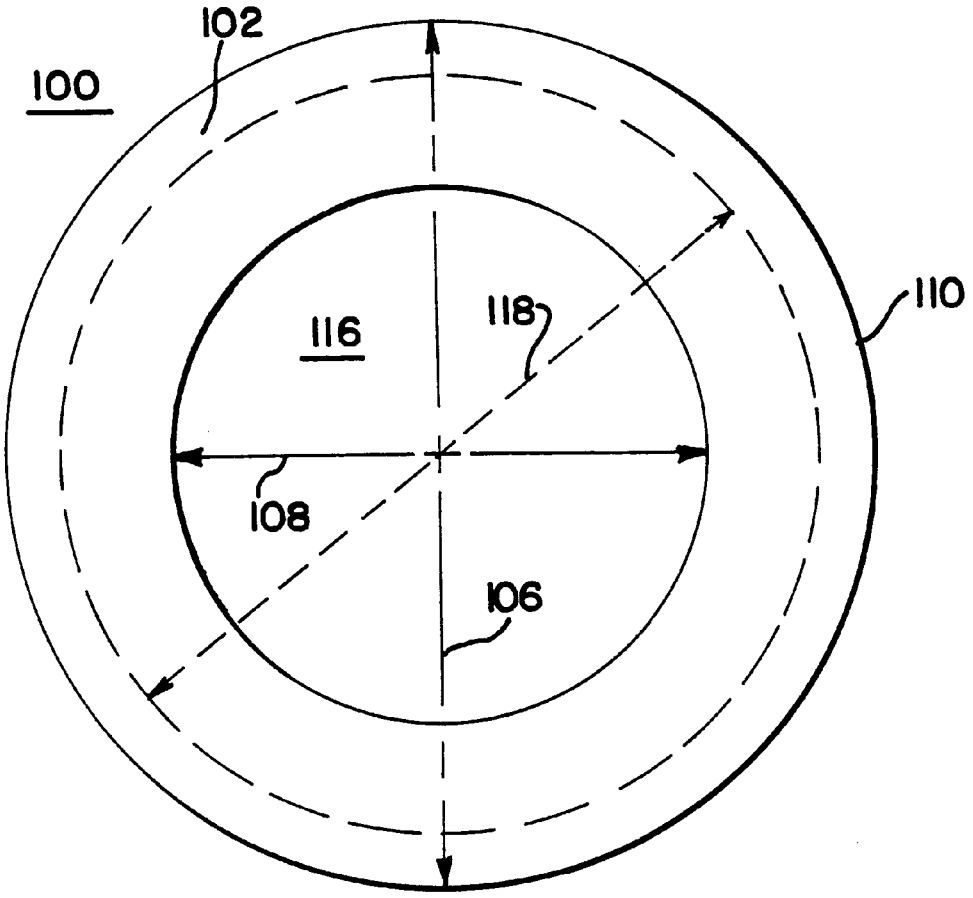

Parting ring 100 is shown in FIGS. 7 and 8, and as noted above has inner diameter 108, which is larger than diameter 244 of tube 242. In FIG. 7, wall 112 with inner diameter 118 extends from lower wall or bottom side 104 to outer bottom surface 115, which inner wall 112 and lower wall 104 provide recess 117 to receive upper surface 60 of holding casting 242.

In the illustration of FIG. 3, tube support ring 150 is seated on tank cover 16 and secured in position by screws 151 extending through bores 149, which are anchored in ports 153 of cover 16. Garlock gasket 155 is nested between tank cover 16 and tube support ring 150 to seal the surfaces between these two components and to avoid seepage or pressure loss during casting.

Holding casting 242 is positioned in opening 241 of tank cover 16 with holding-casting-collar lower surface 86 positioned on tube-support-ring upper surface 157 with pouring tube gasket 243 positioned therbetween to maintain a tight seal. Internal wall 138 of holding ring 30 contacts upper surface 80 of holding casting collar 76, and holding-ring lower face 122 contacts tube-support-ring upper surface 157. Screws 245 of holding ring 30 extend through passage 246 to mate with support-ring passages 247 and secure holding ring 30 to support ring 150.

Pouring tube 224 is placed in holding-casting aperture 64 with lower segment 257 extending through aperture 64. In this configuration, holding-casting third inner diameter 73 is approximately equal to, or slightly larger than pouring tube outer diameter 44 at second inflection point 253. Similarly, tapered tube wall segment 259 is sloped or tapered to generally conform to the slope of holding casting wall section 270 between holding casting inner diameter 72 and inner diameter 73. Upper section 255 with outer diameter 244 extends from inflection point 251 to upper surface 50. After assembly, a narrow gap 275 exists between inner wall 270 of holding casting 242 and pouring tube outer wall 258. This gap is filled with a cementitious refractory compound, which provides both an anchoring and insulating material between holding casting 242 and pouring tube 224.

Parting ring 100 is mated with holding casting upper portion 230, which has outer diameter 232 about equal to parting ring inner diameter 118 to again nest parting ring 100 on upper portion 232 in recess 117. Tube upper segment 255 extends past holding casting top surface 60 to mate with parting-ring bore or port 116. In this arrangement, tube upper surface 50 is about coplanar with parting-ring top surface 102. Gasket 52 is secured to tube upper surface 50 for receipt of a mold 28.

In assembly 218, tube 224 is firmly nested in holding casting 242. Upper segment 255 has a larger diameter 244 than lower diameter 73 of holding casting 242, consequently, tube 224 is anchored in aperture 64 by both the cementitious refractory material and by the mechanical force of gravity wedging tube wall 258 against holding casting wall 270. In this preferred embodiment, the taper of walls 270 and 258 are approximately equal, and the outer diameters of tube 224 are only smaller than the inner wall diameters of holding casting aperture 64 to allow assembly of the components and the introduction of the cementitious refractory material. However, the narrow gap 275 will not permit free passage of tube 224 through holding-casting aperture 64. Thus, positioning a mold 28 atop holding tank cover 16 and holding ring 30 will more firmly nest tube 224 into holding casting 242. This latter action is to prevent tube 224 from being driven out of holding casting 242 as has been experienced with present structures. Tube 224 has a length from bottom 48 to upper end 50 to allow tube 224 to extend into ladle 16 in proximity to ladle bottom 26, and to protrude above holding ring upper face 120 but providing top end 50 approximately level with parting ring top surface 102.

While the present invention has been described in connection with certain specific embodiments thereof, it is apparent that various alterations and modifications can be made therein. It is, therefore, the intention in the appended claims to cover all such modifications and alterations as may fall within the scope and spirit of the invention.

We claim:

1. A pouring-tube assembly for a bottom-pouring ladle and holding tank arrangement used in casting molten metals, said pouring-tube assembly comprising:

a pouring tube, a tank cover, a tube support ring, means for securing said tube support ring to said tank cover, a sealing gasket between said tube support ring and said tank cover, a holding casting for said pouring tube, a parting ring, said parting ring having a generally annular shape with a central bore and an outer surface having an outer diameter, said bore having an inner surface with an inner diameter;

a pouring tube gasket;

said pouring tube being a generally cylindrical ceramic composite having a passage with a longitudinal axis extending through said tube, a lower end, an upper end, an inner wall, and an outer wall;

said pouring-tube outer wall having a first and upper section with a first outer diameter, a second and lower section with a second outer diameter, which second outer diameter is less than said first outer diameter, and a sloped third and central portion extending between said first pouring-tube section and said second pouring-tube section;

said holding casting being generally cylindrical with a central throughbore, a top surface and a bottom surface, said holding casting having a first and upper wall portion with a first outer diameter and a first inner diameter, a collar on said upper wall portion in proximity to said holding-casting top surface, said holding casting having an inner wall portion with a holding-casting, second inner diameter less than said first diameter and in proximity to said top surface, a second and lower inner wall portion about vertically upwardly extending from said bottom surface, said lower inner wall portion having a third inner diameter smaller than said holding-casting second inner diameter, said holding-casting inner wall portion radially inwardly tapered toward said longitudinal axis from said second inner diameter, said inner wall portion and second lower inner wall portion intersecting and cooperating to define a first shoulder, said holding-casting, inner-wall portion tapered to receive said pouring-tube sloped third and central portion;

a refractory sealing agent, said sealing agent applied to said pouring-tube outer wall and said parting-ring, inner-diameter surface;

said pouring tube mated in said holding-casting throughbore with said sealing agent therebetween to secure said pouring-tube sloped central portion with said taper of said holding-casting inner-wall portion, and said parting ring is secured at said pouring-tube upper end against said holding-casting top surface by said sealing agent.

2. A pouring-tube assembly for a bottom-pouring ladle and holding tank arrangement as claimed in claim 1 further comprising a pouring gasket, said pouring gasket positioned and secured on said pouring-tube upper end.

3. A pouring-tube assembly for a bottom-pouring ladle and holding tank arrangement as claimed in claim 1, wherein said composite material is mullite.

4. A pouring-tube assembly for a bottom-pouring ladle and holding tank arrangement as claimed in claim 1, said holding casting further comprising a gap inner wall and a gap floor cooperating to define a gap at said holding-casting top surface, said gap having a gap diameter greater than said holding-casting second inner diameter at a gap inner wall, said gap extending from said holding-casting top surface a predetermined depth to said floor, said floor and gap inner wall intersecting to define a shoulder and, said floor and holding-casting inner wall portion intersecting at said second inner diameter.

5. A pouring-tube assembly for a bottom-pouring ladle and holding tank arrangement as claimed in claim 1, wherein said pouring tube extends a predetermined length above said holding casting top surface, said parting ring having a top side, said parting ring secured on said holding casting top surface and having a fixed height at said first outer diameter to provide said parting ring top side as coplanar with said pouring-tube upper end at an as-assembled reference position.

6. A pouring tube assembly for a bottom-pouring ladle and holding tank arrangement, said assembly and arrangement used in casting molten metals from a holding tank into a mold, said arrangement having a tank cover, a tube support ring, means for securing said tube support ring to said cover, a sealing gasket between said support ring and said tank cover, and a holding ring, said pouring tube assembly comprising:

a pouring tube;

a holding casting for said pouring tube;

a parting ring, said parting ring having a generally annular shape with a bore, an inner surface having an inner diameter and an outer surface having an outer diameter;

a pouring tube gasket;

said pouring tube being a generally cylindrical ceramic composite having a passage with a longitudinal axis extending through said tube, a lower end, an upper end, an inner wall, and an outer wall;

said pouring-tube outer wall having a first and upper section with a first outer diameter, a second and lower section with a second outer diameter, which second diameter is less than said first diameter, and a sloped third and central portion extending between said first and second pouring-tube sections;

said holding casting being generally cylindrical with a central throughbore, a top surface and a bottom surface, said holding casting having a first and upper wall portion with a first outer diameter and a first inner diameter, a collar on said upper wall portion at said holding-casting top surface, said holding casting having an inner wall portion with a holding-casting second inner diameter less than said first diameter and in proximity to said top surface, a first holding-casting inner diameter inboard of said collar and in proximity to said upper end, a holding-casting second and lower inner wall portion about vertically upwardly extending from said bottom surface, said lower wall portion having a third inner diameter smaller than said holding-casting second inner diameter, said holding-casting inner wall portion radially inwardly tapered toward said longitudinal axis from said second inner diameter, said inner wall portion and second lower inner wall portion intersecting and cooperating to define a first shoulder at said intersecting wall portions, said holding-casting, inner-wall portion tapered to receive said pouring-tube sloped third and central portion;

a refractory sealing agent, said sealing agent applied to said pouring-tube outer wall and said parting-ring, inner-diameter surface;

said pouring tube and sealing agent mated in said holding-casting throughbore to secure said pouring-tube sloped central portion with said holding-casting inner-wall tapered portion, and said parting ring is secured at said pouring-tube upper end against said holding-casting top surface by said sealing agent;

said holding ring having an upper face and a lower face, and defining a central duct with a first internal wall with a first internal diameter in proximity to said top, and a second internal wall with a second internal diameter greater than said first internal diameter, said first internal wall and second internal wall intersecting to define a second shoulder to contact said holding-casting collar, said parting ring nested in said holding ring duct, said holding ring secured to said tube support ring and said tank cover by said securing means to secure said pouring tube assembly in position in said tank and to provide a seat for said mold.

7. A pouring tube assembly as claimed in claim 6, wherein said pouring tube outer wall sloped third and central portion has a slope of at least two degrees from a vertical position parallel to said longitudinal axis, which slope is inwardly tapered toward said said tube bore between said first and upper portion and, said second and lower portion.

8. A pouring tube assembly as claimed in claim 7, wherein said holding-casting tapered inner wall portion has an angular slope approximately equal to said slope of said pouring tube outer wall central portion.

* * * * *